US009072923B2

(12) United States Patent
Mason et al.

(10) Patent No.: US 9,072,923 B2
(45) Date of Patent: Jul. 7, 2015

(54) INDUSTRIAL FLOOR NOZZLE AND FIRE FIGHTING SYSTEM

(76) Inventors: Thomas E. Mason, Washington, IN (US); Dwight P. Williams, Vidor, TX (US); Casey R. Spears, Nederland, TX (US)

( * ) Notice: Subject to any disclaimer, the term of this patent is extended or adjusted under 35 U.S.C. 154(b) by 340 days.

(21) Appl. No.: 13/261,425

(22) PCT Filed: Mar. 15, 2011

(86) PCT No.: PCT/US2011/000478
§ 371 (c)(1),
(2), (4) Date: Sep. 5, 2012

(87) PCT Pub. No.: WO2011/115673
PCT Pub. Date: Sep. 22, 2011

(65) Prior Publication Data

US 2013/0000928 A1 Jan. 3, 2013

Related U.S. Application Data

(63) Continuation-in-part of application No. 12/925,037, filed on Oct. 12, 2010.

(60) Provisional application No. 61/340,400, filed on Mar. 17, 2010.

(51) Int. Cl.

| | |
|---|---|
| ***A62C 31/03*** | (2006.01) |
| ***B05B 1/26*** | (2006.01) |
| ***A62C 31/12*** | (2006.01) |

(52) U.S. Cl.
CPC ..... *A62C 31/03* (2013.01); *B05B 1/265* (2013.01); *A62C 31/12* (2013.01)

(58) Field of Classification Search
CPC ..... A62C 31/03; A62C 35/00; A62C 31/005; A62C 31/12; B05B 1/265; B05B 1/30
USPC ..... 239/201, 202, 208, 273, 451–453, 456, 239/457, 459, 504, 203, 204; 169/54
See application file for complete search history.

(56) References Cited

U.S. PATENT DOCUMENTS

| | | | | |
|---|---|---|---|---|
| 1,962,824 | A * | 6/1934 | Lindquist et al. | 239/204 |
| 3,408,006 | A * | 10/1968 | Stanwood | 239/66 |
| 6,126,083 | A * | 10/2000 | Boschung et al. | 239/1 |
| 6,182,767 | B1 * | 2/2001 | Jackson | 169/16 |
| 6,755,356 | B1 * | 6/2004 | Bergquist | 239/288.5 |

* cited by examiner

*Primary Examiner* — Jason Boeckmann
(74) *Attorney, Agent, or Firm* — Sue Z Shaper

(57) ABSTRACT

An industrial floor firefighting system including a grating structured to rest over a trench and a firefighting nozzle attached to the grating, the system preferably characterized in the nozzle having an adjustable discharge gap; in the nozzle barrel being structured with the grating such that the barrel bears essentially no weight from industrial objects on or passing over the grating; in having an adjustable bafflehead/barrel combination that produces a nozzle gap upstream of the nozzle discharge orifice; and/or, as well, producing an annular gap discharge and an essentially annular nozzle discharge.

14 Claims, 16 Drawing Sheets

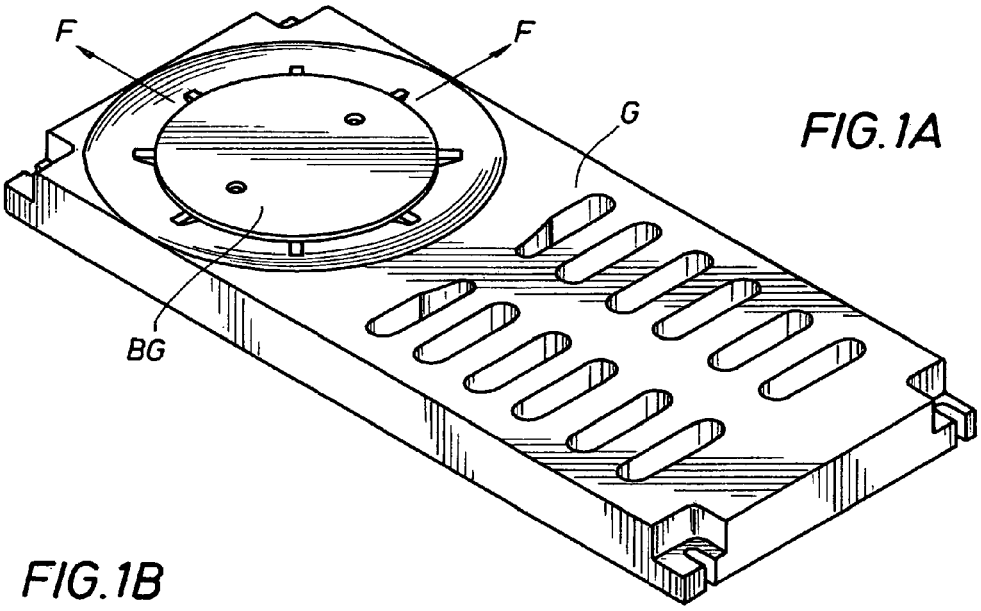
FIG.1A
FIG.1B
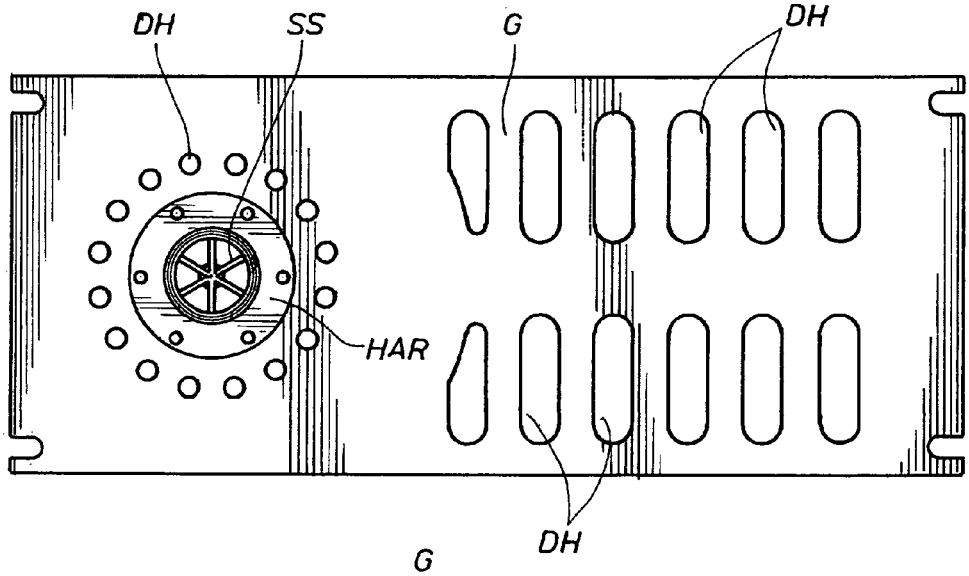
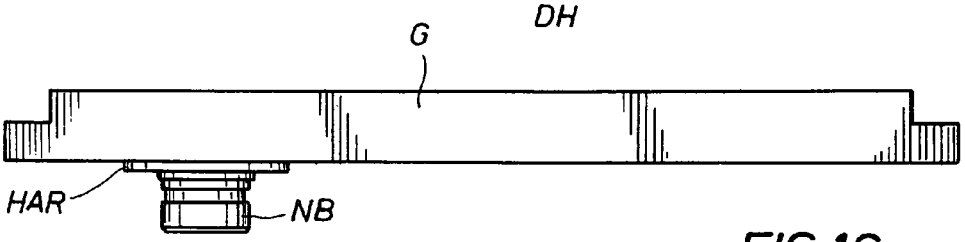
FIG.1C

FIG. 3D
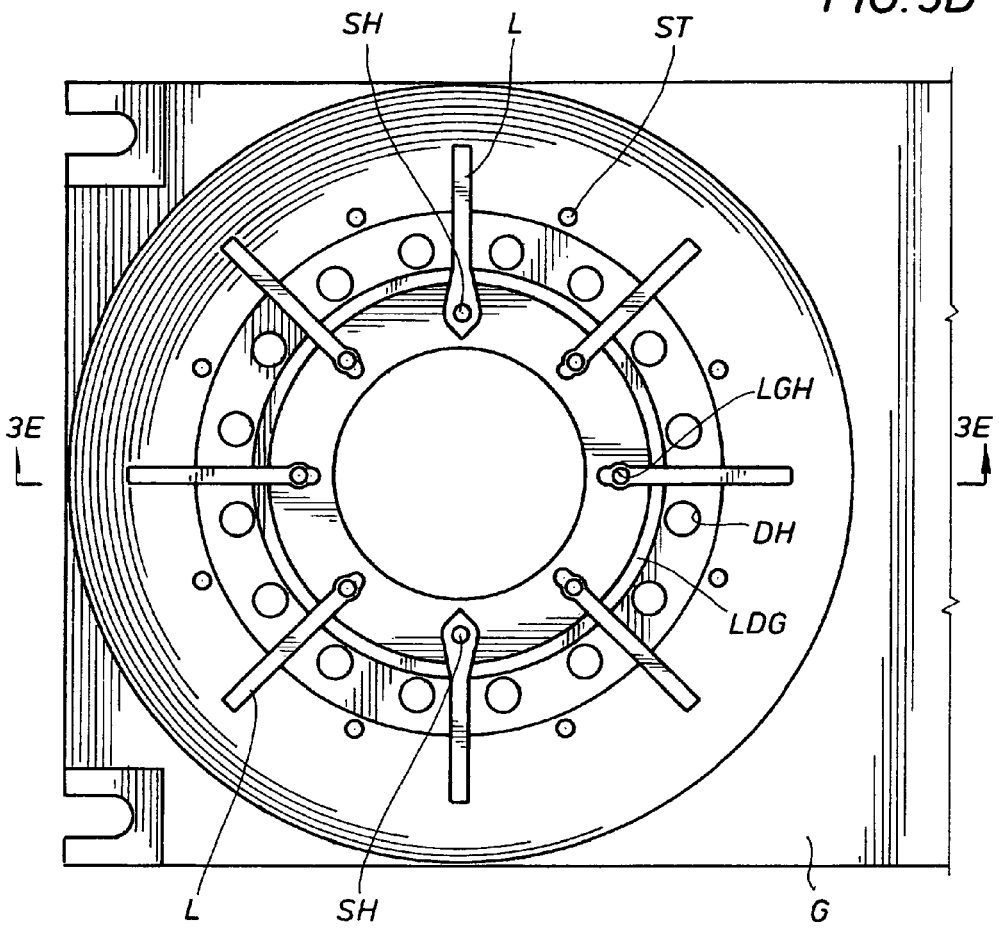
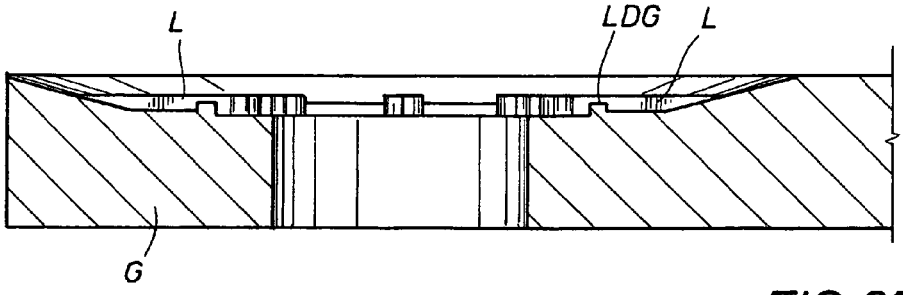
FIG. 3E

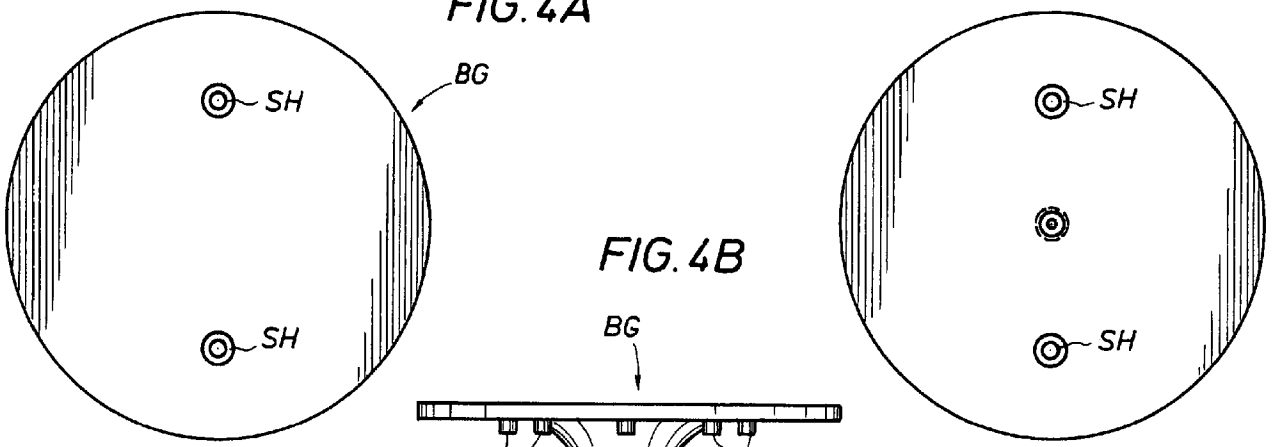
FIG. 4A
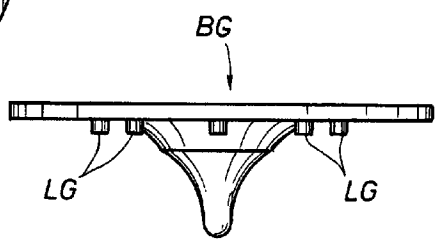
FIG. 4B
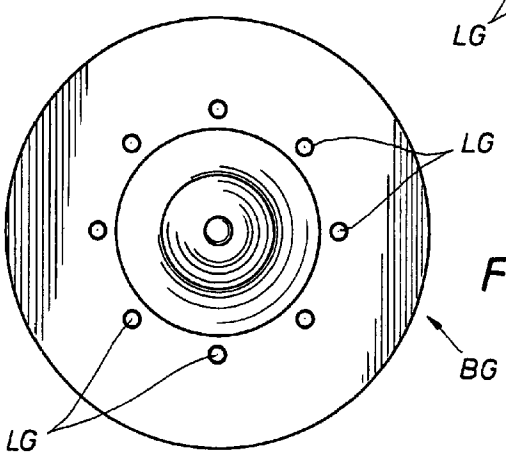
FIG. 4C
FIG. 4D
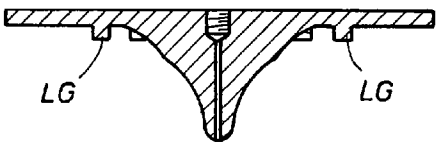
FIG. 4E

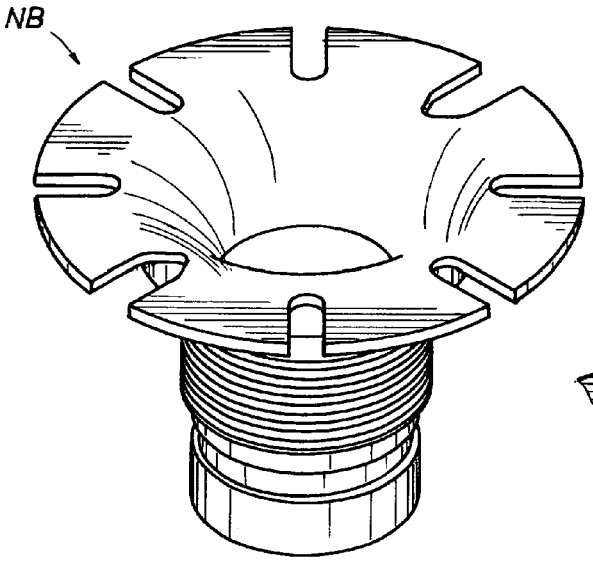
FIG. 5A
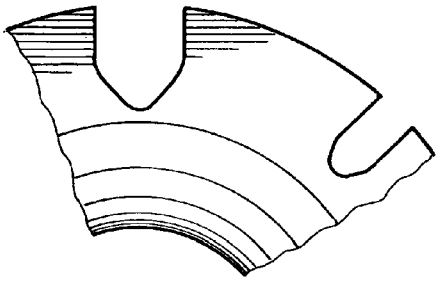
FIG. 5E
FIG. 5B
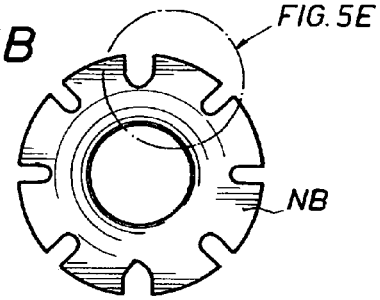
FIG. 5D
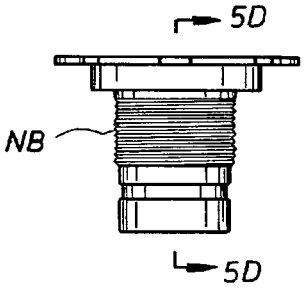
FIG. 5C
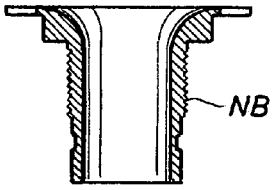

FIG. 7A
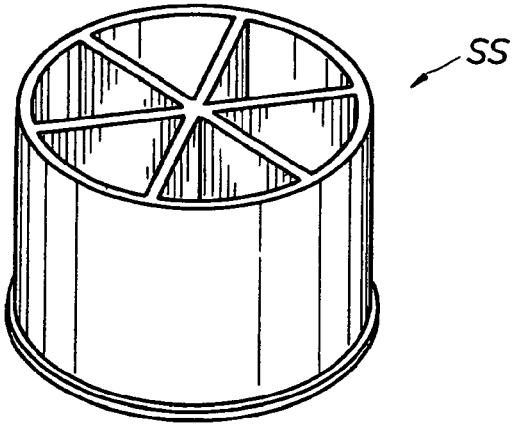
FIG. 7C
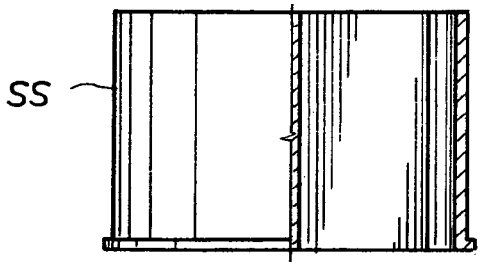
FIG. 7B
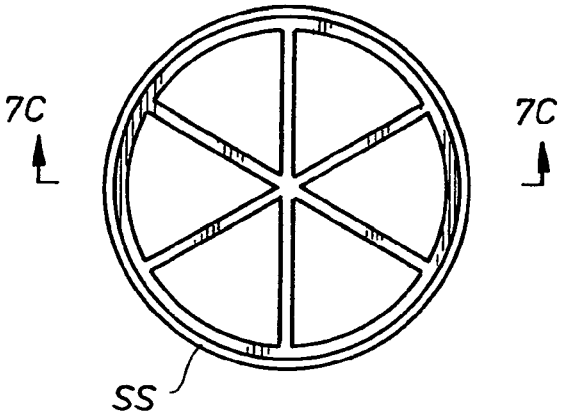
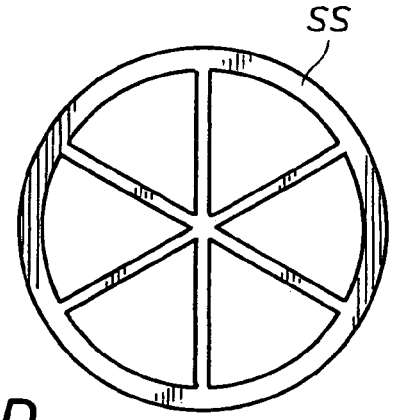
FIG. 7D

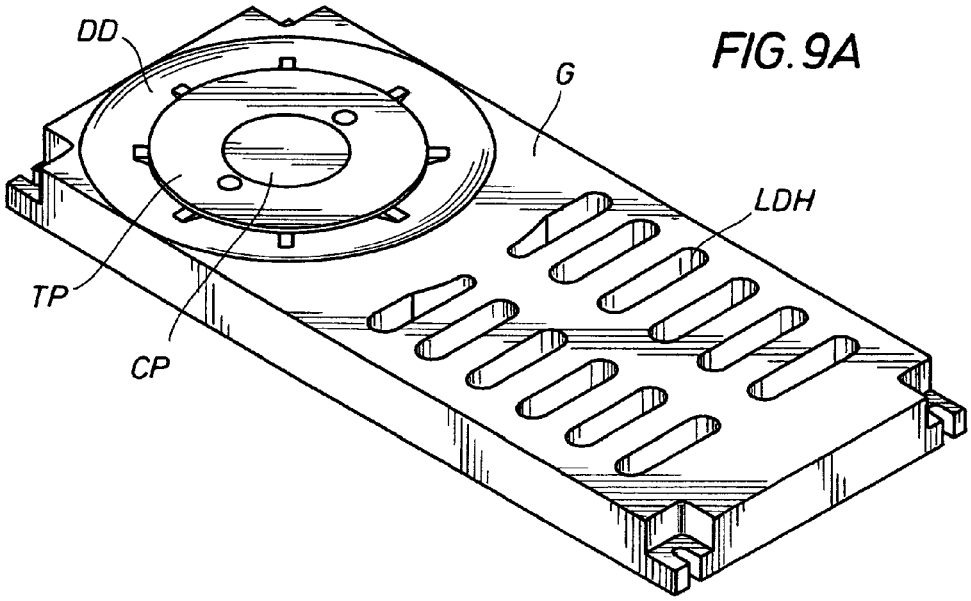
FIG. 9A
FIG. 9B
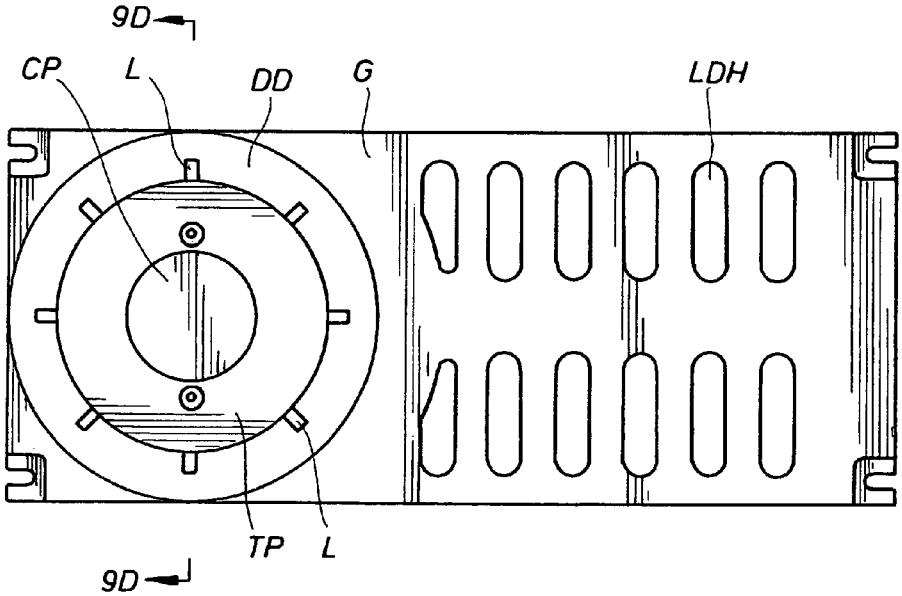

FIG.10A
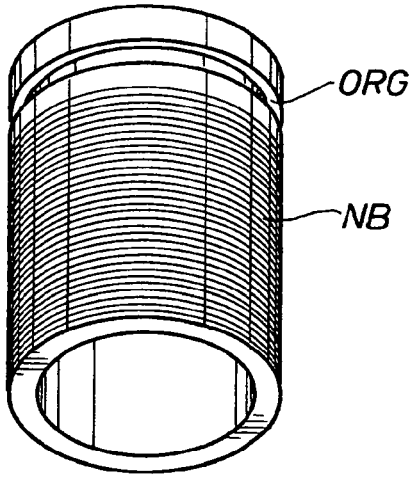
FIG.10C
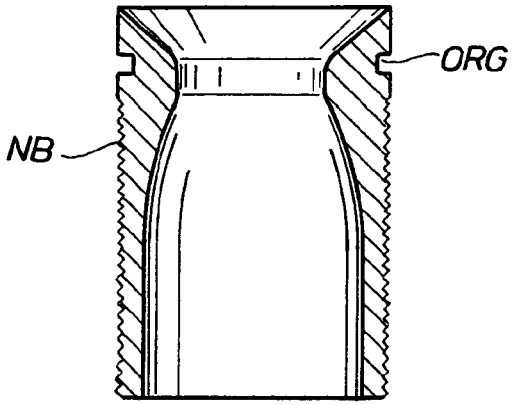
FIG.10B
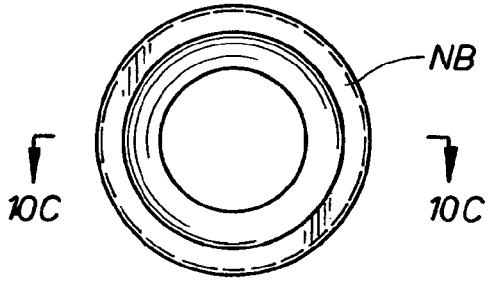
FIG.11A
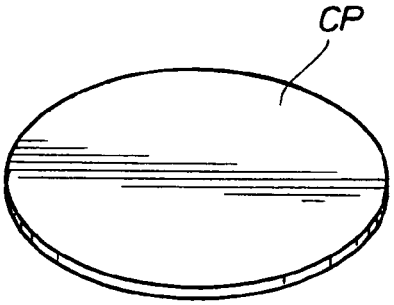
FIG.11B
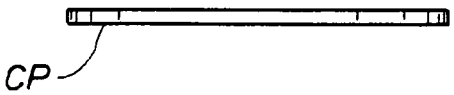
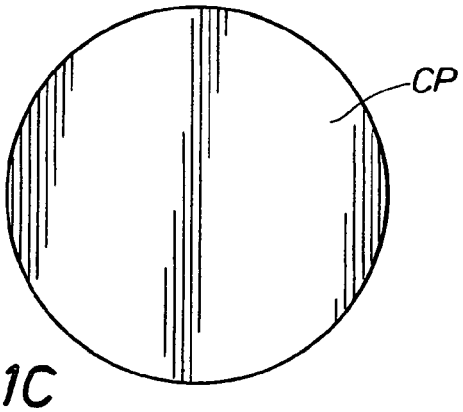
FIG.11C

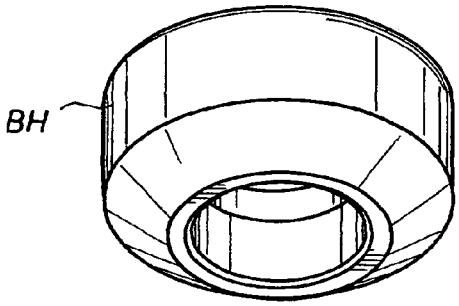
FIG.12A
FIG.12B
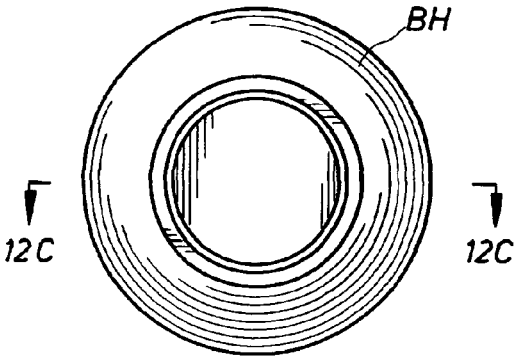
FIG.12C
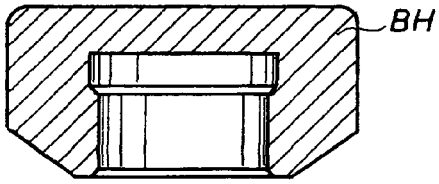
FIG.12D
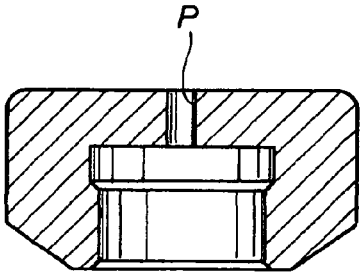
FIG.12E
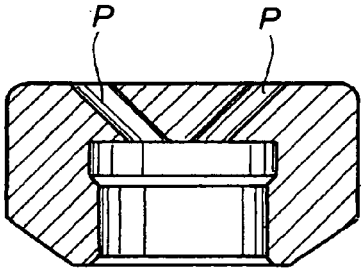

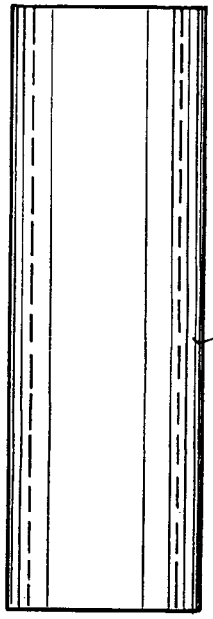
FIG. 14A
FIG. 15A
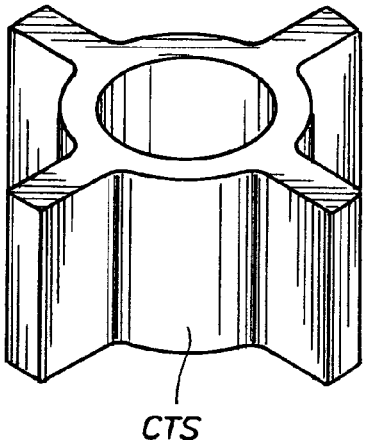
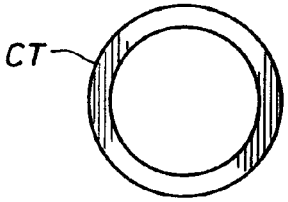
FIG. 14B
FIG. 15C
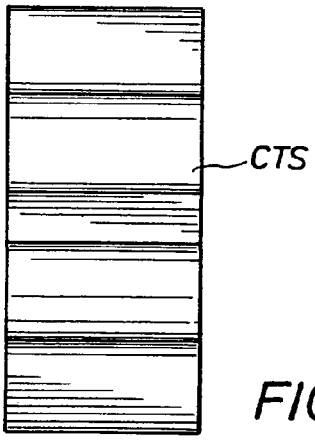
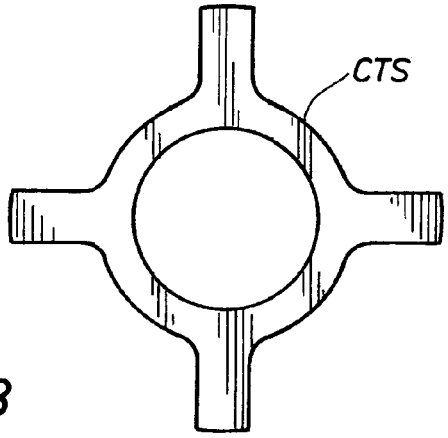
FIG. 15B

INDUSTRIAL FLOOR NOZZLE AND FIRE FIGHTING SYSTEM

CROSS REFERENCE TO RELATED APPLICATIONS

This invention is related to and claims priority to provisional application Ser. No. 61/340,400, filed Mar. 17, 2010, entitled Industrial Floor Nozzle and Fire Fighting System having inventors Thomas E. Mason, Dwight P. Williams and Casey R. Spears; and to co-pending U.S. application Ser. No. 12/925,037, of which this application is a continuation in part, filed Oct. 12, 2010, entitled Improved Drain Nozzle, inventor Thomas E. Mason, and to its related provisional application Ser. No. 61/228,877 of same title and same inventor. The contents of provisional application No. 61/340,400 and of U.S. application Ser. No. 12/925,037 are herein hereby incorporated by reference in their entirety.

FIELD OF THE INVENTION

The field of the invention lies in industrial fire fighting systems and in particular, in floor nozzle systems having nozzles discharging through gratings positioned over trenches.

BACKGROUND OF THE INVENTION

The instant floor nozzles and fire fighting system are adapted to provide a fixed fire fighting system and method for industrial complexes, in particular complexes having expensive equipment and/or personnel whose protection could profit from a significant discharge of fire fighting fluid from trenches in the floor, and where protection may be optimized by having nozzle discharges shaped to optimally cover and protect specified equipment or areas.

Explosions frequently accompany industrial fires and may disable portions or all of fixed sprinkler systems mounted on ceilings or walls, as well as floor mounted monitor systems. Industrial fires and related explosions, however, typically do not affect or disable equipment and apparatus stationed in trenches in an industrial floor. Fire fighting nozzles working out of trenches, thus, can likely more reliably protect equipment and personnel. Trench systems, further, can possibly cover equipment from preferable angles and locations, as compared to sprinkler systems installed in ceilings or walls or fixed monitors stationed around floors. Further again, industrial fires at times "settle" on a floor of a facility. A floor nozzle system, installed in floor drainage trenches, is well positioned to address the settled fire. As an additional advantage, a trench fire fighting system can offer superior protection to personnel walkways during an emergency.

A prior art system for floor nozzles is disclosed in U.S. Pat. Nos. 6,181,767 and 6,371,212, inventor Eldon D. Jackson. The floor nozzle of the Jackson system was initially or primarily designed to meet needs of aircraft hangars. Floor nozzles for aircraft hangars are required to keep their discharges low, below the wings and engines of the aircraft. This can be a stringent design requirement.

Jackson solved problems of prior art hangar nozzle systems that were either (1) pop-up trench nozzles (which created a personnel hazard and possibly malfunction issues); or (2) floor stationed oscillating monitors and nozzles (which could become bumped and moved and misaligned and blocked by equipment); or (3) fixed trench systems (that simply disgorged foam, as opposed to having a nozzle that "threw" foam, and which had poor or slow foam dispensing characteristics.)

Jackson teaches a fixed trench nozzle solution that is permanently situated at optimal locations in floor trenches and need not pop up to provide adequate discharge patterns. The Jackson design avoids creating personnel hazards as well as malfunction or bumping or misaligning or blocking issues. The Jackson fixed trench nozzle is staged flush with the floor and provides a "nozzle," as opposed to a simple foam disgorgement system, which nozzle can discharge foam essentially laterally and in 360°, with significant range.

Jackson's fixed trench nozzle installed flush in the floor is taught to be constructed to bear significant weight. E.g. Jackson's deflector and nozzle barrel are taught to be constructed to be able to bear heavy loads placed on them and their grating by aircraft or the like passing over the floor. Jackson has proved his design's utility by testing.

The Jackson fixed trench nozzle with weight-bearing design, however, provides no adjustable gap, or adjustable K factor, for the nozzle. Removing the nozzle barrel from the trench leaves the grating no longer flush with the floor, providing a personnel hazard. The weight-bearing requirement itself is a significant restriction on design.

The instant inventors determined to develop an alternate trench nozzle to the Jackson design without the full weight bearing requirement of the Jackson system while retaining a 360° predominantly lateral discharge capability, as appropriate for aircraft hangars, if desired. An adjustable gap on K factor and permanently flush grating were also design objectives.

As a result, the instant inventors developed and successfully tested a trench nozzle system able to be permanently stationed at optimum locations in trenches, providing a grating flush with the floor when the nozzle barrel is removed and providing a capability of discharging foam essentially laterally, if desired, and in 360°. At least the nozzle barrel is attached to the grating in a non-weight bearing fashion. In a preferred embodiment a bafflehead is also attached in a non-weight bearing fashion. The design permits providing the nozzle with an adjustable K factor, or adjustable gap, and permits the removal of the nozzle barrel from the trench without destroying the flushness of the floor grating. The design provides an annular discharge in lieu of a plurality of solid bore discharges.

The inventors were required to test their design to prove that the design could perform satisfactorily, including discharging essentially laterally and in 360° and with a requisite range. The ultimate testing provided favorable results.

To summarize the inventors perceived three disadvantages with the Jackson system. (1) The Jackson nozzle barrel must be constructed of significant weight-bearing, compression-bearing materials, without regard to more appropriate materials for constructing nozzle barrels and possibly baffleheads. (2) The Jackson nozzle barrel could not be removed from the trench without disturbing the flushness of the floor grating, a safety factor. (3) The K factor of the Jackson nozzle could not be adjusted.

The inventors' tests indicate that the new nozzle design could achieve essentially lateral radial patterns, as required for delivering fire suppressant to a floor area of an aircraft hangar without discharging at a height that impermissibly impinges upon aircraft itself. Further, a variety of discharge patterns could be achieved, depending upon the particular equipment in an industrial facility to be protected. As a further advantage, the nozzle barrel at least, and preferably a bafflehead also, could be constructed of appropriate material without regard to high compression weight-bearing restrictions. The nozzle discharge pattern could be adjusted by adjusting a stream shaper and/or by adjusting the bafflehead—barrel gap, the nozzle K factor, and/or by designing grating portions and/or bafflehead ports for shaping the nozzle discharge. The nozzle barrel could be removed from the trench without affecting the flushness of the grating and floor.

The instant design diverges significantly from the Jackson design in two structural features. (In the following use of the term "nozzle" will be understood to include all significantly attached fluid conduit defining structure beginning with the nozzle barrel, and will be understood to include not only the nozzle barrel but also any attached bafflehead and/or significant deflector structure and/or stream shaper structure. The nozzle defines a discharge stream and has a discharge end. The "nozzle gap" will be understood to be defined by nozzle structure and to be located at the point in the nozzle creating the greatest restriction on the fluid flow path. The nozzle gap defines a gap discharge stream. The nozzle gap set nozzle discharge pressure and affects range and nozzle flow rate.) Jackson teaches two nozzle embodiments, that of FIGS. 8-13 and that of FIGS. 19-22. Both Jackson embodiments teach a nozzle defining a plurality of "radial discharge passageways" (62, 164) for the fluid. Both are taught to discharge multiple "jets" of fluid. The Jackson's nozzle design teaches, in other terms, a plurality of "solid bore discharge streams," asserted to merge in flight downstream from the nozzle discharge.

By contrast, the instant nozzle structure and design defines an annular discharge stream. The gap defines an annular discharge stream. Jackson's "gap", as determined by his figures above, and as compared to other "solid bore" nozzles, is located essentially at the nozzle discharge point. The instant gap by contrast, is located significantly upstream of the nozzle discharge point, located within a fluid conduit defined by the nozzle that is substantially vertical.

To summarize, the Jackson "hangar nozzles," in particular the nozzle barrels themselves, are designed to bear weight, like the grating, and significant weight is known to pass on and over industrial floor grating. (In the Jackson design a weight bearing deflector is rested directly on a nozzle barrel flange, which in turn rests directly on the grating. The deflector and barrel flange bear weight.) Structuring a nozzle barrel to bear weight limits nozzle barrel flexibility and materials. The nozzle barrel of the instant design is structured together with the grating such that the nozzle barrel, and preferably a bafflehead, essentially bear no weight from objects passing over. Any bafflehead portion or deflector portion of the instant design that bears weight is designed to be part of the grating and does not bear down upon or rest upon the nozzle barrel. Weight passing over the grating is borne by the grating, thus, not a portion of the nozzle barrel. The design further provides the flexibility of being vertically adjustable in at least one sense, so as to be able at least to vary the nozzle K factor. With the instant design the nozzle barrel can be removed from the trench without disturbing the flush surface of the grating.

The instant floor nozzle system further preferably provides an annular discharge stream and an annular "gap" discharge stream, with the gap located significantly upstream of the nozzle discharge point. Preferably the gap is located where the fluid conduit defined by the nozzle is still substantially vertical. In applicant's experience such design characteristics enhance the performance and flexibility of the nozzle. The instant system preferably provides for adjusting the discharge gap of the nozzle and hence the discharge pressure and flow rate of the nozzle. Embodiments of the instant floor nozzle design also preferably provide for ease of removing the nozzle barrel permanently from the trench for repair or replacement while allowing grating and deflectors and caps to remain flush and in place, thus while continuing to provide a flush floor which creates no open personnel hazards.

It is anticipated that the shape of the discharge of the instant industrial floor nozzles, including grating portions, will be tailored by nozzle/grating structure and/or bafflehead structure to specifically cover specified equipment and/or walkways, such as by discharging directly up onto the equipment or by discharging at a 45 degree angle or by discharging laterally, and/or by including combinations of the above.

The gratings of the instant floor fire fighting nozzle system lie over trenches that provide stations for the nozzles and associated supply piping as well as a means for drainage. The nozzles and their associated piping are installed in the trenches. The instant system, in contrast to the Jackson system, is preferably designed such that while the gratings carry the weight of industrial equipment on, or passing over, the gratings, the nozzle barrels at least are attached to the gratings in a manner such that the barrels do not bear such weight. In a preferred embodiment a bafflehead is also designed without weight-bearing structure.

The instant floor nozzle discharges through a port or opening of the grating and portions of the grating may function as discharge shaping or discharge inhibiting or deflecting surfaces. The instant floor nozzle preferably includes a dislodgeable protective cap, resting on the grating over a nozzle barrel, to protect the nozzle from debris. The cap would be designed to blow off under water pressure.

SUMMARY OF THE INVENTION

The invention includes an industrial floor fire fighting system comprising a grating structured to fit over a trench in the floor, the grating defining an opening for fire fighting fluid discharge. The system includes a fire fighting nozzle attached to the grating, located to discharge fire fighting fluid through the opening, the nozzle having a barrel extending into the opening and a bafflehead. The barrel and the bafflehead are structured in combination to define an adjustable discharge gap.

Preferably the system includes the barrel and grating structured in combination such that the barrel bears essentially no weight from industrial objects on, or passing over when the grating is fitted over the trench. Preferably the system includes the nozzle structured to define an annular discharge stream and the gap structured to define an annular gap discharge. Preferably the system includes the nozzle and grating structured in combination to discharge fire fighting fluid substantially lateral.

Preferably the system includes the barrel and bafflehead structured in combination to define a gap significantly upstream of the nozzle discharge point. The system preferably includes the gap located in the fluid conduit defined by the nozzle where the fluid conduit is substantially vertical. Preferably the system includes the barrel vertically adjustably attached to the grating through an adjustable connection fitting. Preferably the system includes the grating opening including a dished area and a removable deflector plate portion extending over portions of the dished area. Preferably the system includes the dished area and/or removable plate portions structured to facilitate a nozzle discharge pattern. Preferably the system includes an internal stream straightener upstream of the discharge gap in the nozzle barrel.

In some embodiments the system includes the bafflehead attached to the grating. In those embodiments the barrel is preferably vertically adjustably attached to the grating through a connection fitting such that the adjustment of the barrel with respect to the fitting adjusts the discharge gap between the barrel and the bafflehead. In those embodiments the system preferably includes the bafflehead attached to a part of a removable plate portion of the grating. In those embodiments the system preferably includes the moveable plate portion of the grating being structured to shape interior portions of an annular discharge stream produced by the defined gap.

In other embodiments the system includes the bafflehead attached to the barrel and separated from the grating. In those embodiments the system preferably includes the barrel vertically adjustably attached to the grating by an adjustable stream shaper and mounting ring, and wherein the barrel vertically adjusts with respect to the stream shaper so as to adjust the discharge orifice of the nozzle. In those embodiments the system preferably includes the bafflehead adjustably attached to the barrel and attached such that adjustment of the bafflehead adjusts the discharge gap of the nozzle. In those embodiments the system preferably includes a blow off cap resting on a grating portion over the nozzle barrel. In those embodiments the system preferably includes the bafflehead structured to provide at least one port through the bafflehead for discharge through the bafflehead and preferably the at least one discharge port for the bafflehead being designed to create a specific discharge pattern for protecting equipment.

The invention preferably includes a method of fire fighting comprising installing fire fighting nozzles associated with gratings and trenches such that nozzle barrels essentially bear no weight passing over or on the gratings and adjusting a discharge gap of the nozzles such that the nozzle discharges through the gratings achieve a predetermined pattern or objective.

BRIEF DESCRIPTION OF THE DRAWINGS

A better understanding of the present invention can be obtained when the following detailed description of the preferred embodiments are considered in conjunction with the following drawings, in which:

FIGS. 1A-1F illustrate an assembly of a preferred embodiment of the instant invention, including perspective, bottom, side, top, side cut-away and side cut-away detail views, respectively.

FIGS. 3A-3E provide views of the grating of the nozzle of FIG. 1, with the bafflehead portion of the grating removed, including top, side, bottom, top detail and side detail cutaway views, respectively.

FIGS. 4A-4E provide views of the bafflehead portion of the grating of FIG. 1, including top, side, bottom, alternate top and alternate side cutaway views, respectively.

FIGS. 5A-5E illustrate the nozzle barrel of the embodiment of FIG. 1 in perspective, top, side, top detail and side cutaway views, respectively.

FIGS. 7A-7D illustrate a stream straightener of the embodiment of FIG. 1, in perspective, top, cut-away and bottom views, respectively.

FIGS. 9A-9D are isometric, top bottom and side cut-away views of the embodiment of FIG. 8.

FIGS. 10A-10C offer isometric, side and side cross section views of a nozzle barrel unit of the embodiment FIG. 8.

FIGS. 11A-11C offer isometric, top and side cut away views of a cap unit.

FIGS. 12A-12C offer isometric, top and side cut away views of a bafflehead unit designed to be attached to the nozzle body unit of FIG. 8, and FIGS. 12D and 12E illustrate optional parts through the bafflehead.

FIGS. 14A-14B offer side and top views of a bafflehead tube or shaft unit of the embodiment of FIG. 8.

FIGS. 15A-15C offer isometric, top and side views of a shaft support unit of the embodiment of FIG. 8.

The drawings are primarily illustrative. It would be understood that structure may have been simplified and details omitted in order to convey certain aspects of the invention. Scale may be sacrificed to clarity.

DESCRIPTION OF THE PREFERRED EMBODIMENTS

Figure 1D:
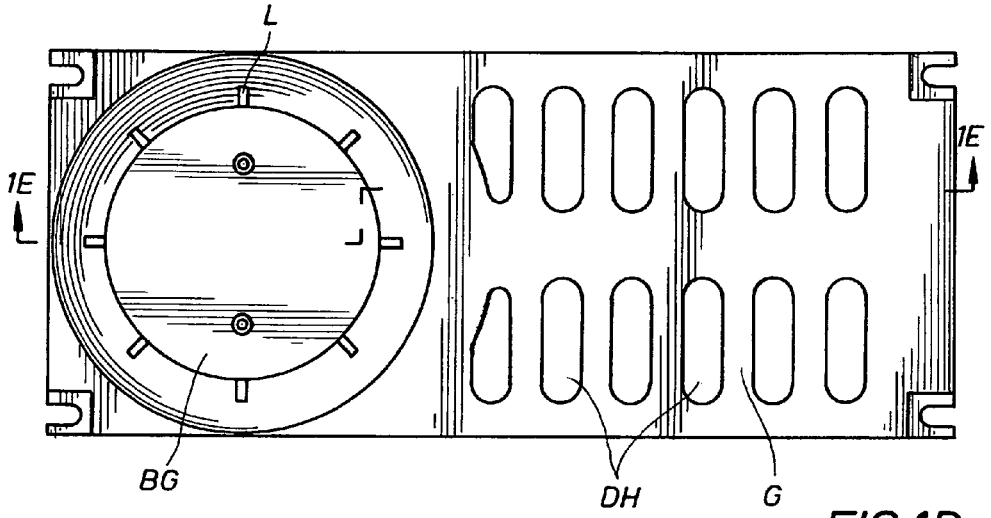
Figure 1E:
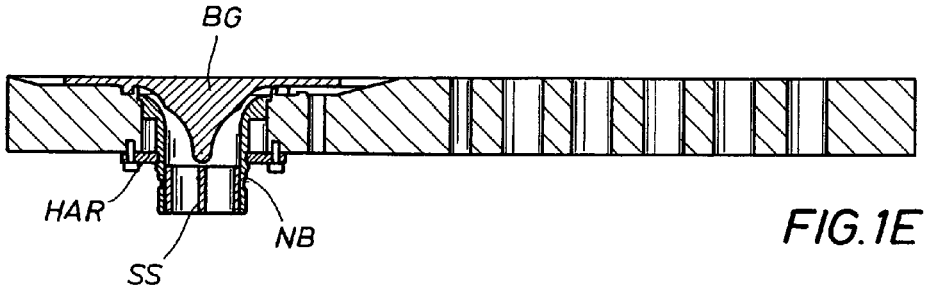
Figure 1F:
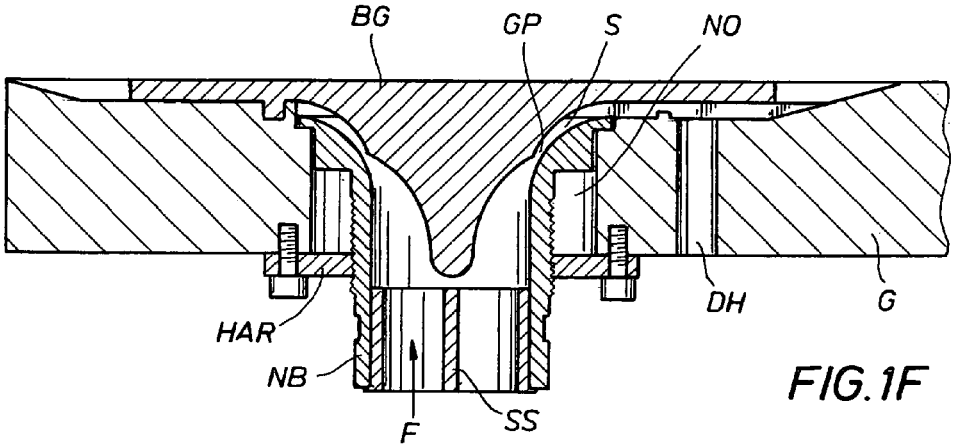

The embodiments of FIGS. 1-7 generally reflect a first preferred drain nozzle design where, as perhaps best illustrated in FIG. 1F, a bafflehead BG for the nozzle is integrated into, and provided by a portion of, a floor grating G. The bafflehead will be of weight bearing material carrying weight similarly with and to the grating. Nozzle barrel NB is adjustably attached to a height adjustment ring HAR that is, preferably, attached to the bottom of the floor grating. The grating provides a port or opening NO for the nozzle. In this preferred embodiment the nozzle barrel does not touch the bafflehead.

A source of firefighting fluid is carried through piping in a trench, not shown, located under the floor grating, to the nozzle barrel NB. A hose or line couples to the nozzle body at a line coupler on the nozzle barrel, in a manner known to the art.

The bafflehead BG and the floor grating G in combination direct firefighting fluid in an annular path through and from the nozzle barrel. In the preferred embodiment illustrated the fluid is directed predominantly laterally in its discharge. A design objective for an aircraft hangar is to direct fire fighting foam discharge 20 feet radially with the foam rising no more than a foot or two vertically from the floor. The purpose of such distribution pattern is to protect equipment standing on the floor while addressing the fire hazard.

The floor grating, including the bafflehead unit of FIGS. 1-7, is constructed of material having a strength sufficient to support the weight of anticipated vehicles or equipment traveling thereover, or resting thereon such as aircraft.

Drainage ports DH are provided in the grating in general and in particular under the bafflehead. If the annular discharge area around the bafflehead is obstructed, as by a vehicle tire for instance, fluid should still pass through the nozzle and back through the grating through drainage ports DH under the bafflehead into the trench, thereby avoiding a significant effect on supply pressure.

Preferably a spacing S and gap GP between the nozzle barrel and the bafflehead are adjustable, as by a height adjustment ring HAR, in order to be able to adjust the k-factor of the nozzle. Alternately, the spacing could be bias controlled to regulate pressure. An adjustable screw connection between ring HAR and nozzle barrel NB is illustrated.

In all embodiments it is preferred for a portion of the grating to be removable in order to provide access from the top to the nozzle and associated lines.

Figure 2:
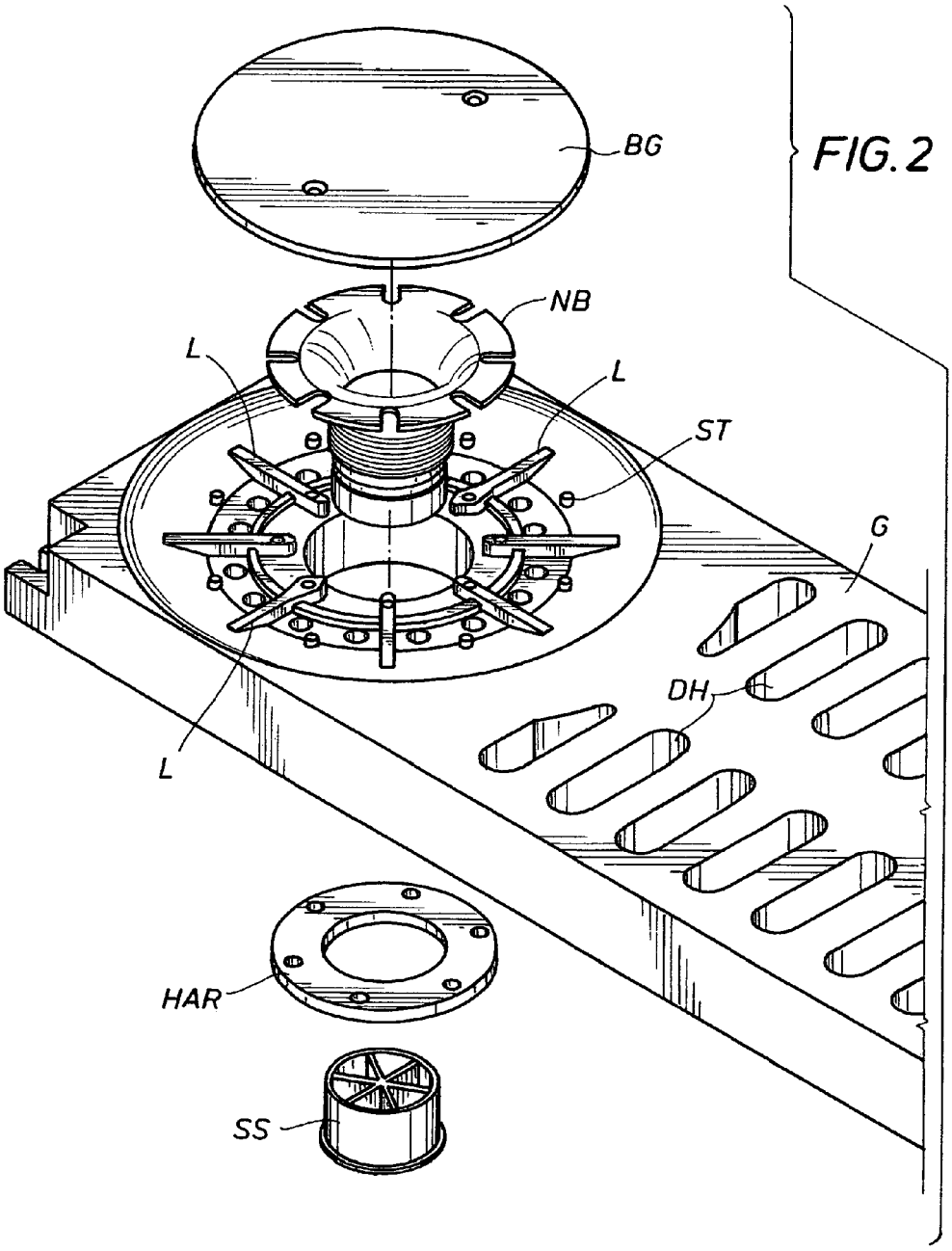
FIG. 2 is an exploded isometric view of the nozzle of FIG. 1.

FIG. 1 illustrate an assembly of a preferred embodiment of a drain nozzle for an aircraft hangar. FIG. 1 are best reviewed in conjunction with FIG. 2 which offers an exploded isometric view of the same assembly of FIG. 1. As can be seen in FIG. 2 the assembly is comprised of essentially five pieces or elements: 1) grating G; 2) separable bafflehead portion BG of grating G; 3) nozzle body or barrel NB; 4) height adjusting ring HAR; 5) and stream straightener SS.

Figure 3A:
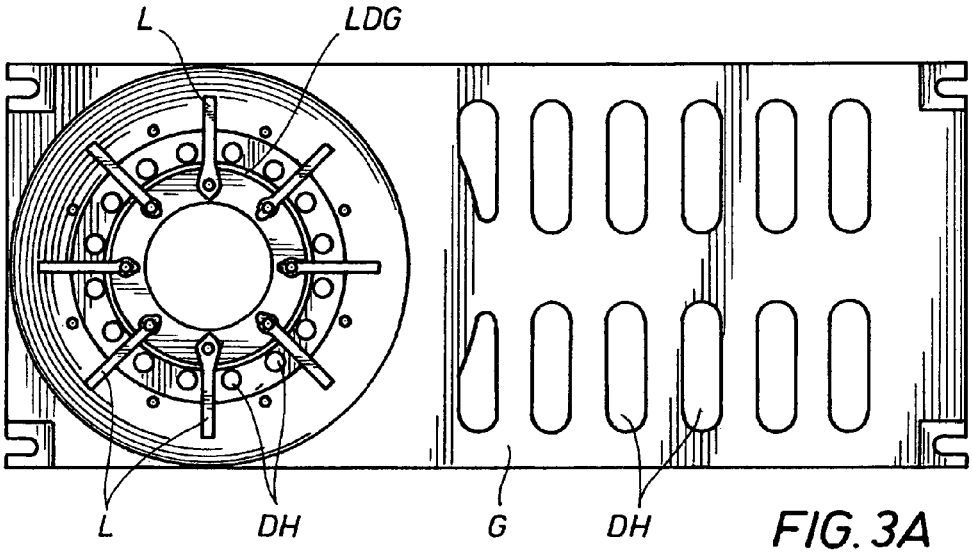
Figure 3B:
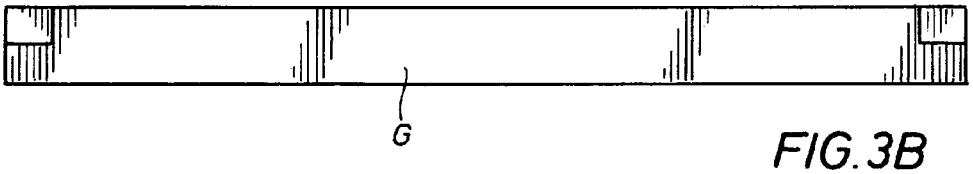
Figure 3C:
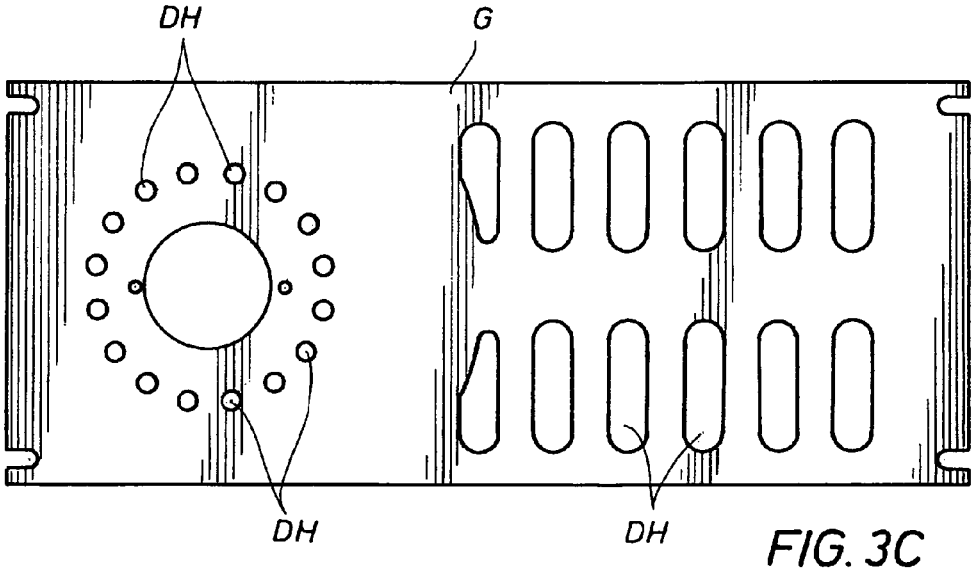

Stream straightener SS, especially FIG. 7, is preferably press fit into the lower portion of nozzle barrel NB in a manner known and appreciated in the art, to yield improved nozzle discharge. Height adjustment ring HAR, especially FIG. 6, adjusts into position under the bottom of grating G as illustrated in FIG. 1F. Nozzle barrel NB is preferably provided with lower external threads that screw into internal threads of the inside of height adjustment ring HAR. Screw holes are provided, as illustrated in FIG. 3, in the bottom of grating G, such that the height adjustment ring can attach to the bottom of grating G in six different positions, providing further flexibility for the adjustment of the height of nozzle NB with respect to the grating G and bafflehead BG. Bafflehead BG attaches by screws at two positions to ledges L, shown in FIGS. 1, 2 and 3, provided on the grating to support the bafflehead BG. Further, round stobs ST of grating G, FIG. 2, also support bafflehead BG.

Bafflehead BG could be molded and produced in one piece with grating G. However, in the aircraft hangar embodiment, users explicitly wish to be able to remove any covering over the nozzle body and access the equipment below the grating therethrough. Hence the bafflehead is part of the grating but can be constructed in the order of a removable manhole cover.

Nozzle barrel NB, as more clearly disclosed in FIGS. 5 and 6, attaches to height adjusting ring HAR. Nozzle barrel NB in the preferred embodiment of the FIGS. 1-7 does not touch the grating, including the bafflehead portion of the grating.

FIGS. 1E and 1F illustrate in cross section the assembly of the stream straightener, nozzle barrel, height adjustment ring, grating and bafflehead portion of grating. FIG. 1 also illustrates two types of drain holes DH provided to drain fluid through the grating. The drain holes located in a circle in the region under the bafflehead portion of the grating are arranged to specifically drain foam from the nozzle barrel when the discharge portions of the grating are covered up. Arrows F in FIG. 1A illustrate the discharge pattern of the foam as dictated by the structure of the grating and the bafflehead portion of the grating.

FIG. 3 illustrate in greater detail just the grating without the bafflehead portion. Ledge LDG is particularly visible. A function of ledge LDG is to assist draining foam back into drain holes DH provided under the bafflehead BG.

FIG. 4 illustrate, especially in the cross section of the bafflehead, that the bafflehead contains, in the preferred embodiment, six downwardly projecting lugs LG. The lugs fit into lug holes LGH illustrated in FIG. 3. The lug holes LGH are in the inside end of the landings L.

FIG. 3 also illustrates the eight stobs ST that rise up like the landings to help support the bafflehead portion BG.

One additional function of the lugs LG and the lug holes LGH on the bafflehead and grating respectively is to help the bafflehead resist torque forces or rotation or twisting.

In two locations the bafflehead will form a screwed connection with holes SH of the landings L as illustrated in FIG. 3.

FIG. 4 also illustrate in the bafflehead an optional pressure tap configuration. The bafflehead of FIG. 4E contains a tapped hole in which a pressure instrument can be inserted in order to optimize the operation of the system. FIG. 4 also illustrate that the bafflehead incorporates grating structure that can be used to shape the discharge pattern of the nozzle, the shaping being performed on the inside of the annular discharge.

FIG. 5 illustrates the nozzle barrel with notched flanges for fitting around the ledges L.

In operation in one preferred embodiment the nozzle body is supported by the height adjustment ring HAR. The nozzle body does not rest upon any portion of the grating. Further, the nozzle body does not touch at any place the bafflehead portion of the grating.

Figure 6D:
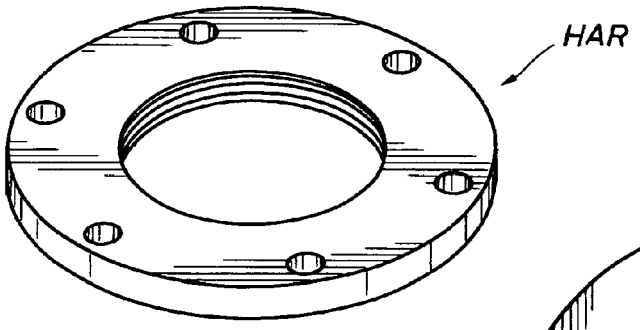
FIGS. 6B-6D illustrate a height adjustment ring of the embodiment of FIG. 1 in top, perspective and side views.
Figure 6B:
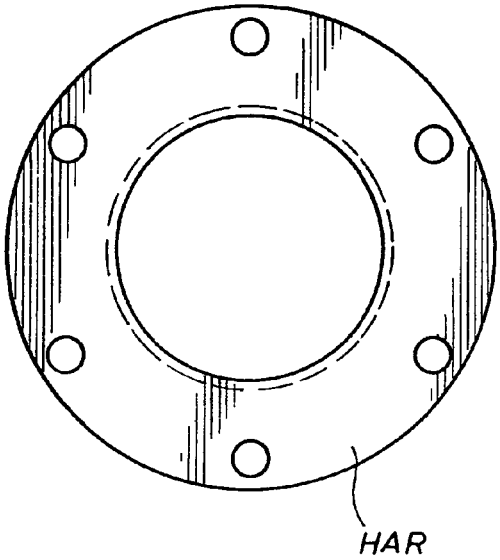
Figure 6C:
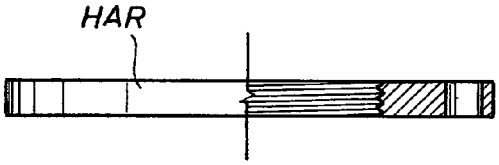
Figure 6A:
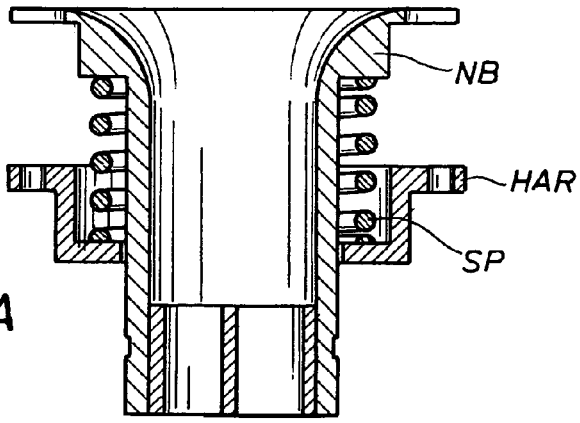
FIG. 6A illustrates an alternate pressure regulating height adjustment ring in cut-away.

As illustrated in FIG. 6 and FIG. 6A, the height adjustment ring can be essentially a ring with provisions for attaching to the bottom of the grating at various points and an interior screw thread for adjustably mating with the nozzle barrel.

Alternate FIG. 6A illustrates that the height adjustment ring could have an extension that receives the bottom of the nozzle body on top of a spring SP held within a cup of the height adjustment ring. The function of the spring or other like biasing element would be to keep the nozzle body at a separation gap from the bafflehead such that the discharge pressure of the foam was a targeted amount.

Figure 8:
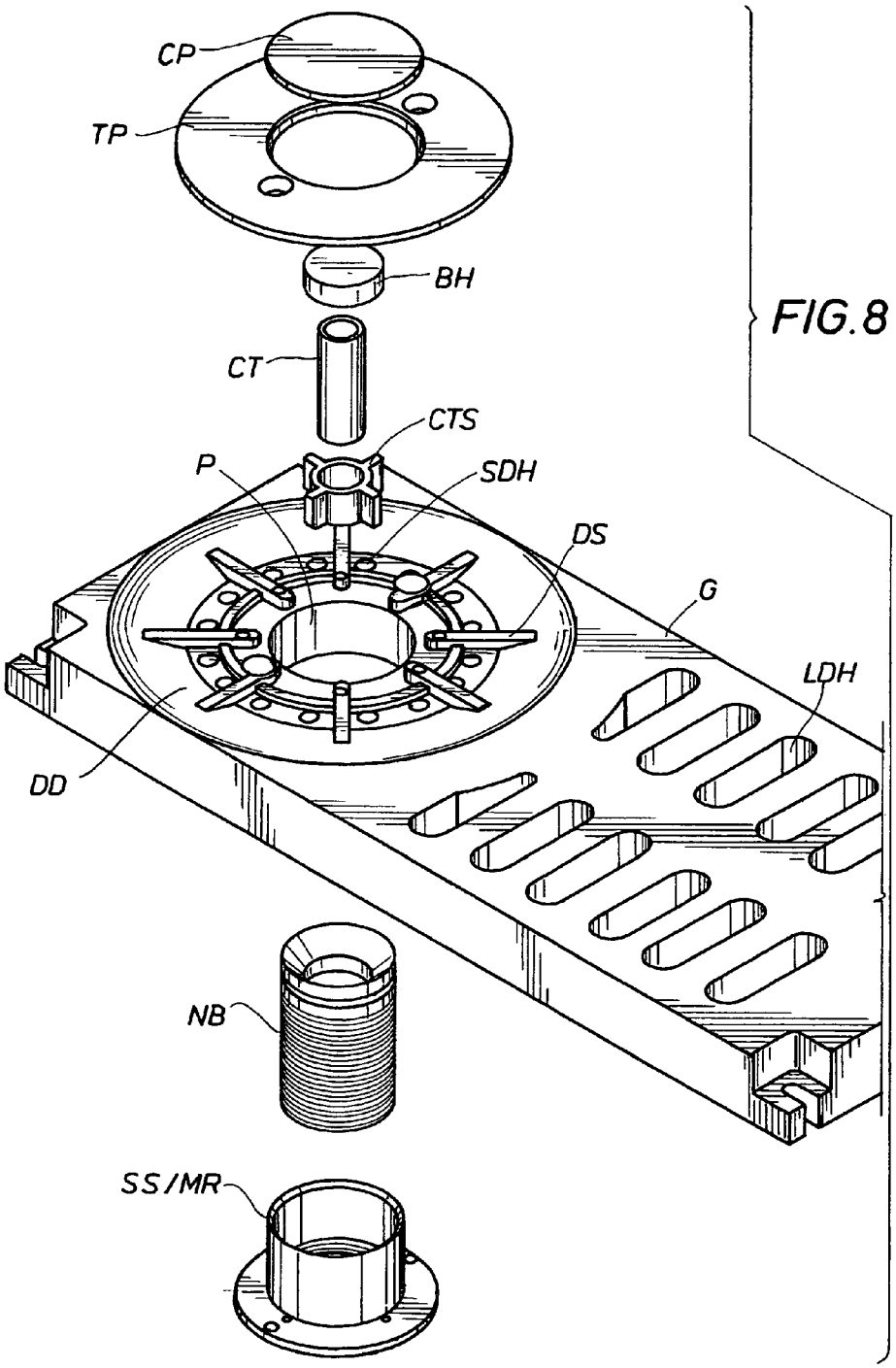
FIG. 8 is an assembly drawing of a second preferred embodiment, exploded view.

FIGS. 8-15 illustrate a second preferred embodiment of the instant invention. FIG. 8 provides an exploded view of the second preferred embodiment. The primary differences between the second preferred embodiment and the first preferred embodiment is that in the second embodiment the nozzle is designed to easily discharge vertically as well as laterally. The bafflehead BH is attached to the nozzle body or barrel NB and not the grating G. The grating contains a top plate TP that is removable to provide access to the nozzle beneath. The top plate enables use of substantially the same grating as in the first embodiment and in addition the top plate can be used, if desired, to help direct discharge. The second preferred embodiment also contains a blow-off stand by cap CP. Further, in the second preferred embodiment, the nozzle body is attached to the grating by means of a stream shaper/mounting ring SS/MR. The stream shaper/mounting ring gives an option of adjusting the shape of a discharge stream. The gap or K factor of the nozzle is adjusted by adjusting the bafflehead BH and center tube CT within the center tube support CTS.

In FIGS. 9A-9D grating G generally corresponds to a grating generally suitable for use with the first embodiment of the invention, previously disclosed.

Grating G is designed to rest upon and fit over a trench in an industrial floor. The grating is designed to fit substantially flush with the floor and to bear the weight of objects passing over the trench and grating.

A grating is preferably comprised of cast iron or the like and is of a substantial thickness, in order to bear substantial weight.

Viewing FIGS. 8 and 9 together, grating G incorporates large drain holes LDH to drain fluid from the floor into the underlying trench, through which the fluid further drains out. In a portion of the grating around a port or opening NO the grating preferably incorporates small drain holes SDH more directly related to a nozzle and a fire fighting system. A depressed or dished out portion DO of grating G surrounds port or opening NO, which opening is designed for accommodating a nozzle. The depressed or dished out portion may also accommodate an overlying top plate TP resting on ledges L.

The second preferred drain nozzle embodiment is designed for the nozzle to discharge in a variety of directions, including in particular, directly vertical, substantially vertical, in 45 degree angles from the vertical, and the like, and including interior straight bore discharges inside of an annular discharge.

In addition to a grating G, the second preferred drain nozzle embodiment includes a stream shaper/mounting ring unit SS/MR, a nozzle barrel NB, a center tube support unit CTS, a center tube unit CT, a bafflehead unit BH, a top plate unit TP and a standby cap unit CP.

The stream shaper/mounting ring SS/MR is structured to affix to the bottom of the grating below and around port or opening NO provided to accommodate a nozzle barrel. The nozzle barrel is preferably designed to adjustably attach to the stream shaper/mounting ring, as by a threaded attachment. The adjustable attachment provides means for adjusting the vertical height of the nozzle body, and any bafflehead attachment, in order to permit the stream shaper to shape a portion of the discharge stream.

The center tube support unit CTS is preferably supported on the nozzle barrel (by means not shown) at or along lower portions of the nozzle barrel. The center tube CT is preferably designed to adjustably attach to the center tube support, as by threaded attachment. A bafflehead BH maybe designed to further adjustably attach to the center tube as by threaded attachment. The adjustable attachment permits adjusting the nozzle gap, GP, or K factor.

The top plate TP fits above and around the nozzle body port or opening NO in and on the grating. The top plate TP attaches directly to the grating, such as to the support ledges L of the grating. The top plate TP is part of the grating, although it is removable in order to provide access to the port or opening in the grating and to the nozzle body and parts thereof and to the trench below. A standby cap CP preferably drops into and rests on the grating in the center of top plate TP. The standby cap rests lightly in the center such that fluid pressure from a nozzle below blows the standby cap off.

The cross-sectional views of the second preferred embodiment assembly clarify the relationships between the grating, the top plate, the standby cap, the bafflehead, the center tube, the center tube support and the nozzle barrel of the preferred embodiment. (Note again that the support for the center tube support in or on the nozzle body has not been indicated. It is possible that the center tube support would be allowed to adjust vertically a small distance within the nozzle body, such as ⅛ of an inch.)

Figure 9C:
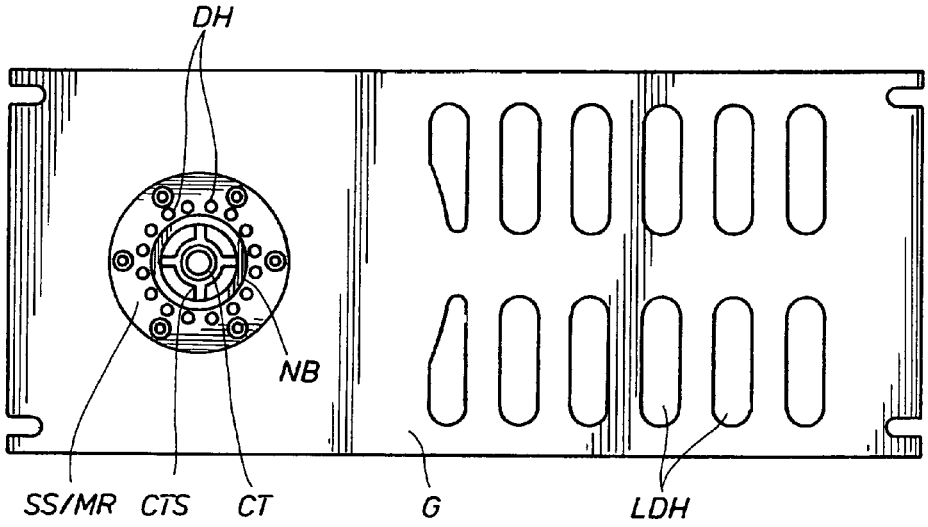
Figure 9D:
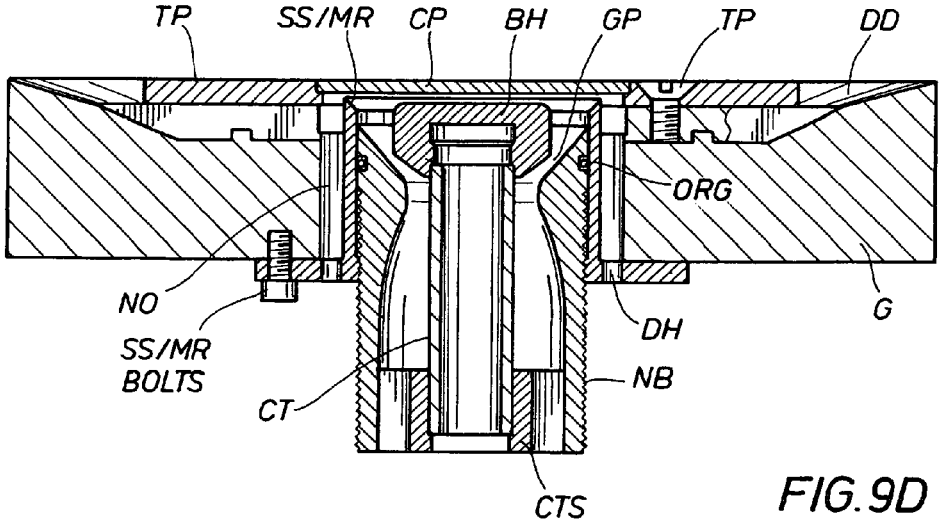
Figure 13A:
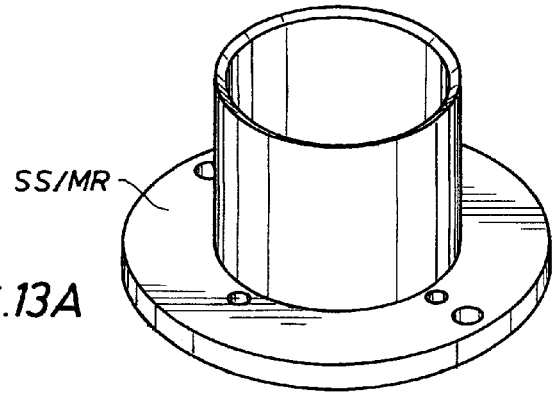
FIGS. 13A-13C offer isometric, top and side cut away views of a stream shaper/mounting ring unit of the embodiment of FIG. 8.
Figure 13B:
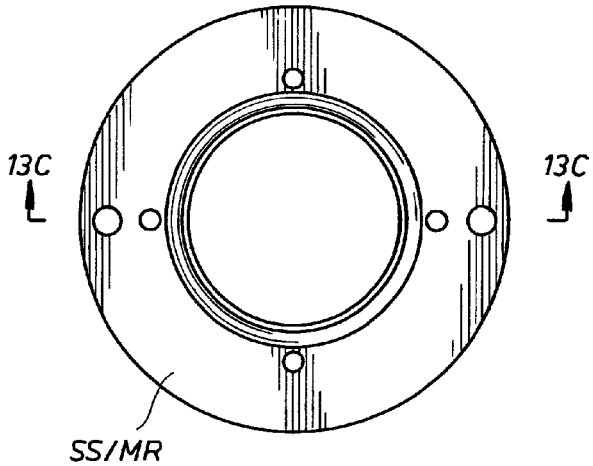
Figure 13C:
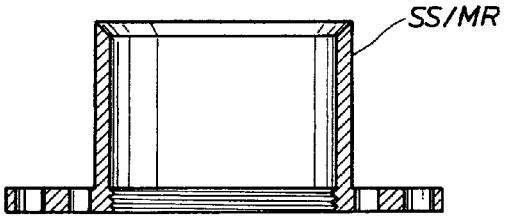

Note that as shown in FIGS. 12D and 12E, it is intended for the bafflehead to be further drilled with ports P, when desired, in order to permit discharge of firefighting streams predominantly vertically. A groove ORG, FIG. 9D, is shown for the placement of an O-ring between the nozzle barrel and the stream shaper/mounting ring.

The nozzle barrel again is preferably designed to adjustably attach to the stream shaper/mounting ring. A preferred means for an adjustable attachment would be a threaded attachment between the stream shaper mounting ring and nozzle barrel. It is preferred that the center tube will have a vertically adjustable attachment to the center tube support, such as a threaded attachment. Even further, the bafflehead preferably has a vertically adjustable threaded attachment to the center tube support. Vertical adjustment permits adjusting of the flow and the range to be achieved by the nozzle as well as the vertical relationship of the nozzle and the grating. If the center tube support and thus the center tube were to vertically adjust as a result of fluid pressure, one configuration may have the bafflehead resting on the nozzle body when not in use. By such means debris can be also further prevented from falling through the nozzle body.

The stream shaper/mounting ring also preferably provides its own additional drain holes to drain away water and debris from the nozzle. Again, the standby cap is designed to rest upon the top of the grating or grating portion and to be blown away by the pressure of fluid flowing upwards through the nozzle.

FIGS. 10 through 15 illustrate preferred structure for a nozzle body, a cap, a bafflehead, a stream shaper mounting ring, a center tube and a center tube support shaft for a preferred embodiment of the invention. In particular FIGS. 12D and 12E illustrate alternate ports P that could be created through a bafflehead to vary the discharge pattern, in addition to an annular discharge. In some circumstances a port through a bafflehead could be created to attempt to create a wall of water, for instance.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

What is claimed is:

1. A flush industrial floor fire fighting system, comprising: a grating structured to fit over a trench in an industrial floor, the grating defining an opening for a fire fighting fluid discharge;

a fire fighting nozzle attached to the grating, located to discharge fire fighting fluid through the opening, the nozzle having a barrel adjustably attachable, directly or indirectly, to the grating and a bafflehead, separate from the grating, independently adjustably attachable to the barrel, where adjustably attachable includes in the direction of flow;

the barrel and the bafflehead structured in combination to define an adjustable annular discharge gap, the gap adjustable independently from the adjustable attachment of the barrel to the grating, and the nozzle and grating structured in combination, directly or indirectly, to define a substantially flush floor surface for the fire fighting system, including during discharge.

2. The system of claim 1 wherein the barrel is vertically adjustably attached to the grating through an adjustable connection fitting.

3. The system of claim 1 wherein the grating opening includes a dished area and a removable deflector plate portion extending over portions of the dished area.

4. The system of claims 3 including the dished area and/or removable plate portion structured to facilitate a nozzle discharge pattern.

5. The system of claim 1 including a removable top plate portion of the grating.

6. The system of claim 1 wherein the barrel is vertically adjustably attached to the grating through an adjustable mounting ring and wherein the barrel vertically adjusts so as to adjust the discharge orifice of the nozzle.

7. The system of claim 1 including a blow-off cap resting on a grating portion over the nozzle barrel.

8. The system of claim 1 wherein the nozzle defines a predominant flow path for fluid discharge and the adjustable annular discharge gap lies within the predominant flow path.

9. The system of claim 8 wherein the adjustable annular discharge gap is adjustable to a plurality of fixed open positions.

10. The system of claim 1 including the grating providing drain holes to drain fluid through the grating into the trench.

11. A flush industrial floor fire fighting system, comprising:

a grating structured to fit over a trench in a floor, the grating defining an opening for a fire fighting fluid discharge;

a fire fighting nozzle attached to the grating, located to discharge fire fighting fluid through the opening, the nozzle having a barrel adjustably attachable, directly or indirectly, to the grating and a bafflehead independently adjustably attachable to the barrel, where adjustably attachable includes in the direction of flow;

the barrel and the bafflehead structured in combination to define an adjustable annular discharge gap, the gap adjustable independently from the adjustable attachment of the barrel to the grating, and the barrel and grating structured in combination, directly or indirectly, to define a substantially flush floor surface for the fire fighting system; and including the bafflehead providing one or more ports to define one or more secondary streams.

12. A method of industrial fire fighting, using fire fighting nozzles installed in trenches of an industrial floor, the floor having gratings over the trenches substantially flush with the floor, comprising:

discharging the nozzles through the gratings while maintaining a substantially flush surface with the industrial floor;

adjusting, in a direction of flow, adjustable annular discharge gaps of the nozzles to one of a plurality of fixed open discharge positions, the gaps defined between a nozzle barrel portion and a bafflehead portion within a predominant flow path for fluid discharge defined by the nozzle, the bafflehead portion being separate from the grating; and independently of the adjusting of the discharge gaps of the nozzles, adjusting attachment of barrels of the nozzles to the gratings, including annular discharge stream shapers with respect to the nozzles, such that the nozzles discharge through the gratings to achieve predetermined spray patterns.

13. The method of claim 12 including discharging one or more secondary streams through one or more ports provided in baffleheads of the nozzles.

14. The method of claim 12 including draining fluid through the gratings into the trenches.

* * * * *